US005283025A

United States Patent [19]

Uda et al.

[11] Patent Number: 5,283,025

[45] Date of Patent: Feb. 1, 1994

[54] PROCESS FOR PRODUCING MULTIFILAMENTS

[75] Inventors: Hitoshi Uda; Tetsuya Takahashi; Ryosuke Kamei; Takeshi Sano, all of Kanagawa, Japan

[73] Assignee: Showa Denko Kabushiki Kaisha, Tokyo, Japan

[21] Appl. No.: 99

[22] Filed: Jan. 4, 1993

[30] Foreign Application Priority Data

Jan. 9, 1992 [JP] Japan ..... 4-2216
Feb. 4, 1992 [JP] Japan ..... 4-19108

[51] Int. Cl.[5] ..... D01D 5/088; D01D 5/092; D01D 5/096

[52] U.S. Cl. ..... 264/130; 264/210.8; 264/211.12; 264/211.15; 264/211.17; 264/237

[58] Field of Search ..... 264/129, 130, 210.8, 264/211.12, 211.15, 211.17, 237

[56] References Cited

U.S. PATENT DOCUMENTS 3,995,004 11/1976 Heinrich et al. ..... 264/237 X
4,863,662 9/1989 Hasegawa et al. ..... 264/130

FOREIGN PATENT DOCUMENTS 2155207 5/1972 Fed. Rep. of Germany ..... 264/237
56-4731 1/1981 Japan .
61-152840 7/1986 Japan .

*Primary Examiner*—Leo B. Tentoni
*Attorney, Agent, or Firm*—Sughrue, Mion, Zinn, Macpeak & Seas

[57] ABSTRACT

A process for producing multifilaments which has the steps of: melt spinning a polyolefin at a first temperature; cooling the spun filaments with a first chill means which is of a non-contact type and is held at a second temperature; cooling the filaments at a third temperature with a second chill means which is of a contact type for forcibly cooling the filaments; and drawing continuously the filaments at high draw ratio in-line with heating rolls having a predetermined surface temperature so that the filaments cooled at the third temperature are directly and continuously treated by the heating rolls.

14 Claims, 1 Drawing Sheet

PROCESS FOR PRODUCING MULTIFILAMENTS

BACKGROUND OF THE INVENTION

The present invention relates to a method for producing multifilaments. Mulitifilaments formed of polyolefins such as polypropylene and polyethylene are used to make pile yarns for ropes, nets, and carpets or as raw yarns for nonwoven fabrics.

In general, to manufacture multifilaments from thermoplastic resins, a number of molten filaments extruded through a spinneret are cooled in an ambient air stream by passage through a cooling duct less than 3–5 m long as they are taken up with drafting being effected at a comparatively high speed of approximately 300 m/min. Thereafter, the filaments are drawn, crimped, and otherwise processed in separate steps.

With the recent improvement in the performance of winders, a method called "direct spin and draw" has been proposed to perform a continuous process including the steps of spinning, drawing, and crimping. However, this method is incapable of producing high-strength multifilaments having satisfactory fiber strength.

SUMMARY OF THE INVENTION

An object, therefore, of the present invention is to provide a process for producing high-strength polyolefinic multifilaments by the direct spin and draw method.

In order to develop a process for producing high-strength polyolefinic multifilaments by the direct spin and draw method, the present inventors conducted intensive studies and found that their objective could be attained by a process comprising the steps of melt spinning a polyolefin, cooling the spun filaments with air by passage through a cooling duct, cooling the filaments with a chill roll having a surface temperature of 5°–30° C. and then continuously drawing the filaments at high draw ratio in-line with a heating roll having a surface temperature of 80°–150° C.

Examples of the polyolefin that can be used in the present invention include low-density polyethylene, medium-density polyethylene, high-density polyethylene, polypropylene, poly-1-butene and poly-4-methylpentene-1. Any polyolefins may be used as long as they can be molded into filament assemblies by melt extrusion and there is no particular limitation on such factors as the molecular weight, density and molecular weight distribution Nevertheless, in case of polypropylenes, it is preferable to use the polypropylenes having a narrow molecular distribution which meet the following condition:

$$Mw/Mn < 7.0$$

where Mw is the weight-average molecular weight and Mn is the number-average molecular weight.

According to the invention, there is provided a process for producing multifilaments, comprising the steps of: melt spinning a polyolefin at a first temperature; cooling the spun filaments with a first chill means which is of a non-contact type and is held at a second temperature; cooling the filaments at a third temperature with a second chill means which is of a contact type for forcibly cooling the filaments; and drawing continuously the filaments at high draw ratio in-line with heating rolls having a predetermined surface temperature so that the filaments cooled at said third temperature are directly and continuously treated by said heating rolls.

According to another aspect of the invention, there is provided an apparatus for producing multifilaments, comprising: means for melt spinning a polyolefin at a first temperature; first chill means for cooling the spun filaments, said first chill means being is of a non-contact type and is held at a second temperature; second chill means for cooling the filaments at a third temperature, said second chill means being of a contact type for forcibly cooling the filaments; and means for drawing continuously the filaments at high draw ratio in-line with heating rolls having a predetermined surface temperature, said drawing means being located in series with said second chill means.

DESCRIPTION OF THE PREFERRED EMBODIMENTS

A first method of the present invention is described below.

Figure 1:
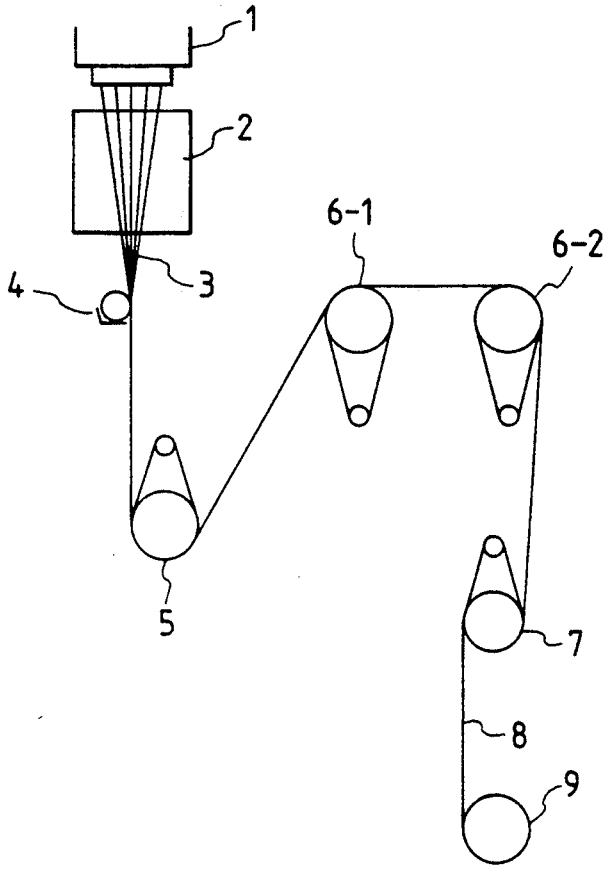
FIG. 1 is a schematic view showing an apparatus for implementing a method according to the present invention.

FIG. 1 shows an example of the apparatus that can be used to implement the present invention. A polyolefin is extruded from an extruder (not shown) through a spinning nozzle 1 to produce undrawn multi-filaments 3. The shaping temperature is desirably as high as possible on the condition that filament assemblies can be produced without causing deterioration of the polyolefin. The spinning nozzle 1 is preferably such that the extruded filaments can be cooled uniformly.

The spun but undrawn multifilaments are cooled to solidify by passage through a cooling duct 2. Cooling may be performed to such an extent that the individual filaments will not fuse together, with the temperature in the cooling duct being desirably adjusted to lie within the range of 5°–40° C. and with air being supplied at a flow rate of 0.1–0.5 m/sec. After cooling, the filaments are treated with oil or gathering agent by means of an oiling roller 4.

The oil treated multifilaments are then cooled with chill rolls 5. The chill rolls 5 are typically godets but other rolls such as nip rolls may be used. The chill rolls 5 may be of Nelson roll type including a pair of rolls which are arranged with their rotary axes being somewhat offset from each other in order to prevent the filaments from being locally wound around the rolls. The chill rolls 5 must have a surface temperature of 5°–30° C., preferably, 5°–20° C.

The surface temperature of the chill rolls 5 has a substantial effect on the linear strength of the multifilaments. The use of takeup rolls has been known but they have not been used to achieve positive cooling as in the present invention and it has been entirely unknown that positive conductive cooling is effective in achieving marked improvements in the physical properties of multifilaments.

Suitable cooling media are water, brine, etc., and they are desirably supplied in a circulating system.

The multifilaments cooled with the chill rolls 5 are drawn on heating rolls 6-1 and 6-2 and the drawn multifilaments 8 are cooled on a chill godet roll 7 and thereafter wound up as the product on takeup roll 9. The heating roll may be a godet roll, nip rolls, etc. In this case, it is preferable to make surfaces of the heating rolls 6-1 and 6-2 mirror-finished in order to increase contact area between the filaments and roll surfaces. Drawing may be performed in multiple stages. The drawing temperature is typically in the range of 80°-150° C., with range of 100°-140° C. being particularly preferred. Drawing is preferably effected at a high draw ratio of 8-15. If the draw ratio is less than 8, only multifilaments of low strength are produced. On the other hand, it is difficult to perform drawing at draw ratios exceeding 15.

EXAMPLES

Example 1

In the apparatus shown in FIG. 1, a polypropylene having MFR of 7.8/10 min (ASTM D 1238, L) (molecular distribution Mw/Mn of 4.0) available from Showa Denko K.K. under the trade name "SHOWALLOMER TA 553-4" was extruded from an extruder (40 mm in diameter) through a multifilament spinning nozzle having 68 holes (0.6 in diameter) at an extrusion temperature of 280° C. in a throughput of 35 g/min. The undrawn multifilaments as the extrudates were passed through a cooling duct 900 mm long, in which they were cooled with air at a temperature of 18° C. that was flowing at a velocity of 0.5 m/sec. The cooled filaments were treated with an oil by means of an oiling roller and thereafter cooled with a godet roll that was held at a surface temperature of 15° C. by means of circulating water and which was rotating at a peripheral speed of 35 m/min. Subsequently, the filaments were heated on a pair of draw rollers having a surface temperature of 120° C. and wound up at a speed of 300 m/min. The multifilaments thus produced were found to have a linear strength of 8.0 g/d and an elongation of 14%.

Example 2

The procedure of Example 1 was repeated except that the chill godet roll was held at a surface temperature of 5° C. The multifilaments produced were found to have linear strength of 9.0 g/d and an elongation of 12%.

Example 3

A polypropylene having MFR of 14 g/10 min (ASTM D 1238, L) (molecular distribution Mw/Mn of 6.2) available from Showa Denko K.K. under the trade name "SHOWALLOMER MH510H" was extruded from an extruder (40 mm in diameter) through a multifilament spinning nozzle having 68 holes (0.6 in diameter) at an extrusion temperature of 280° C. in a throughput of 35 g/min. The undrawn multifilaments as the extrudates were passed through a cooling duct 900 mm long, in which they were cooled with air at a temperature of 18° C. that was flowing at a velocity of 0.5 m/sec. The cooled filaments were treated with an oil by means of an oiling roller and thereafter cooled with a godet roll that was held at a surface temperature of 15° C. by means of circulating water and which was rotating at a peripheral speed of 35 m/min. Subsequently, the filaments were heated on a pair of draw rollers having a surface temperature of 120° C. and wound up at a speed of 210 m/min. The multifilaments thus produced were found to have a linear strength of 5.9 g/d and an elongation of 33%.

Example 4

A polypropylene having MFR of 2.5 g/10 min (ASTM D 1238, L) (molecular distribution Mw/Mn of 5.1) available from Showa Denko K.K. under the trade name "SHOWALLOMER TA253" was extruded from an extruder (40 mm in diameter) through a multifilament spinning nozzle having 68 holes (0.6 in diameter) at an extrusion temperature of 280° C. in a throughput of 35 g/min. The undrawn multifilaments as the extrudates were passed through a cooling duct 900 mm long, in which they were cooled with air at a temperature of 18° C. that was flowing at a velocity of 0.5 m/sec. The cooled filaments were treated with an oil by means of an oiling roller and thereafter cooled with a godet roll that was held at a surface temperature of 15° C. by means of circulating water and which was rotating at a peripheral speed of 50 m/min. Subsequently, the filaments were heated on a pair of draw rollers having a surface temperature of 120° C. and wound up at a speed of 370 m/min. The multifilaments thus produced were found to have a linear strength of 7.6 g/d and an elongation of 27%.

Example 5

A polypropylene having MFR of 330 g/10 min (ASTM D 1238, L) (molecular distribution Mw/Mn of 4.9) available from HH441 (made by HIMONT company) was extruded from an extruder (40 mm in diameter) through a multifilament spinning nozzle having 68 holes (0.6 in diameter) at an extrusion temperature of 200° C. in a throughput of 20 g/min. The undrawn multifilaments as the extrudates were passed through a cooling duct 900 mm long, in which they were cooled with air at a temperature of 18° C. that were treated with an oil by means of an oiling roller and thereafter cooled with a godet roll that was held at a surface temperature of 15° C. by means of circulating water and which was rotating at a peripheral speed of 50 m/min. Subsequently, the filaments were heated on a pair of draw rollers having a surface temperature of 110° C. and wound up at a speed of 300 m/min. The multifilaments thus produced were found to have a linear strength of 4.6 g/d and an elongation of 15%.

Comparative Example 1

The same resin as used in Example 1 was spun into filaments. After treatment with an oil, the filaments were not passed around the chill godet roll 5 at a speed of 35 m/min but they were directly passed between the pair of draw rollers to be drawn at a temperature of 120° C. A maximum draw speed that could be achieved was only 140 m/min. The multifilaments thus produced were found to have a linear strength of only 3.8 g/d and an elongation of 140%.

Comparative Example 2

The procedure of Example 1 was repeated except that the chill godet roll was held at a surface temperature of 40° C. The multifilaments produced were found to have a strength of only 3.5 g/d and an elongation of 170%.

Comparative Example 3

The same resin as used in Example 5 was spun into filaments. After treatment with an oil, the filaments were not passed around the chill godet roll 5 at a speed of 50 m/min but they were directly passed between the pair of draw rollers to be drawn at a temperature of 110° C. A maximum draw speed that could be achieved was only 140 m/min. The multifilaments thus produced were found to have a linear strength of only 2.2 g/d and an elongation of 80%.

The process of the present invention allows high-strength multifilaments to be produced by the direct spin and draw method without performing spinning and drawing in two separate steps.

Multifilaments of high strength and low elongation can be produced without performing spinning and draw in two separate steps.

Figure 2:
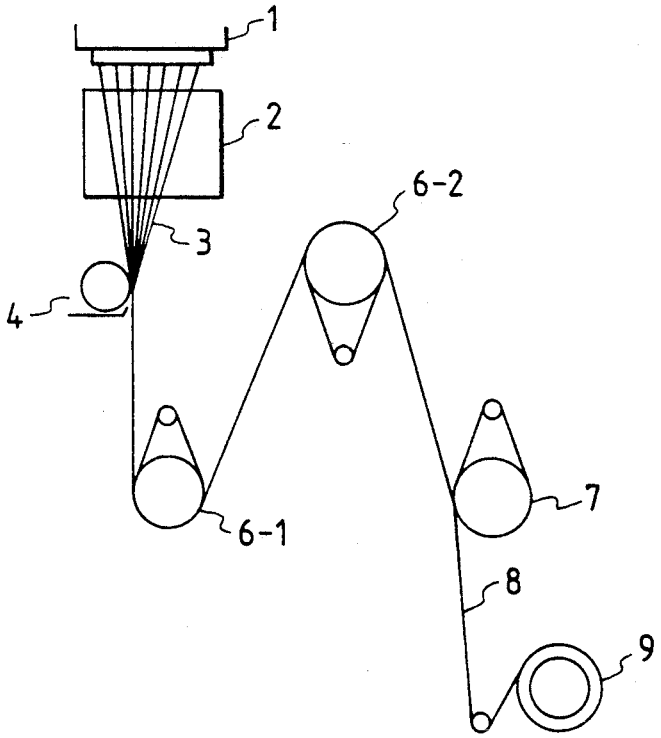
FIG. 2 is a schematic view showing another apparatus for implementing another method according to the present invention.

FIG. 2 shows another example of the apparatus that can be used to implement the present invention. In the same way as the previous embodiment, a polyolefin is extruded from an extruder through a spinning nozzle 1 to produce undrawn multi-filaments 3.

The shaping temperature is desirably as high as possible on the condition that filament assemblies can be produced without causing deterioration of the polyolefin; that is, the polyolefin to be used is spinnable but non-decomposed.

The spinning nozzle 1 is preferably such that the extruded filaments can be cooled uniformly.

The spun but undrawn multifilaments are cooled to solidify by passage through a cooling duct 2. Cooling may be performed to such an extent that the individual filaments will not fuse together, with the temperature in the cooling duct being desirably adjusted to lie within the range of 5°-40° C. and with air being supplied at a flow rate of 0.1-0.5 m/sec.

The undrawn multifilaments cooled by passage through the cooling duct 2 are then quenched and supplied with a gathering agent by means of a gathering agent supply roller 4. This roller must have a temperature of 0°-0° C., with the range of 0°-5° C. being preferred. The gathering agent to be used is not limited in any particular way as long as it will neither solidify nor deteriorate at temperature of 0°-10° C.

The temperature of the gathering agent supply roller 4 has a substantial effect on the linear strength of the multifilaments.

The use of roller 4 for supplying a gathering agent has been known but they have not been used to achieve positive conductive cooling as in the present invention and it has been entirely unknown that positive conductive cooling is effective in achieving marked improvements in the physical properties of multifilaments.

Suitable cooling media are water, brine, etc., and they are desirably supplied in a circulating system.

The multifilaments 8 cooled with the roll 4 are drawn on heating rolls 6-1 and 6-2 and the drawn multifilaments are cooled on a chill godet roll 7 and thereafter wound up as the product on a takeup roll 9. The heating rolls 6-1 and 6-2 may be godet rolls, nip rolls, etc. Drawing may be performed in multiple stages. The drawing condition may be substantially the same as the previous method implemented by the apparatus shown in FIG. 1.

Example 6

In the apparatus shown in FIG. 2, a polypropylene having MFR of 7.8/10 min (ASTM D 1238, L) (molecular distribution Mw/Mn of 4.0) available from Showa Denko K.K. under the trade name "SHOWALLOMER TA 553-4" was extruded from an extruder (40 mm in diameter) through a multifilament spinning nozzle having 68 holes (0.6 in diameter) at an extrusion temperature of 280° C. in a throughput of 120 g/min.

The undrawn multifilaments as the extrudates were passed through a cooling duct 900 mm long, in which they were cooled with air at a temperature of 18° C. that was flowing at a velocity of 0.5 m/sec. The filaments were quenched and supplied by the cooling gathering agent supply roller which was rotated at a peripheral speed of 3 m/min and which was cooled at 5° C. with gathering agents. Subsequently, the filaments were heated on a pair of draw rollers having a surface temperature of 120° C. and wound up at a speed of 300 m/min so that the filaments were drawn at a speed of 2,000 m/min. The multifilaments thus produced were found to have a linear strength of 7.0 g/d and an elongation of 20%.

Example 7

The procedure of Example 6 was repeated except that the gathering agent supply roller roll was cooled at 10° C. and that the filaments were drawn at a speed of 1,500 m/min. The multifilaments produced were found to have linear strength of 6.0 g/d and an elongation of 40%.

Comparative Example 4

The same resin as used in Example 6 was spun into filaments which were supplied with a gathering agent from a roller that was not cooled. In the subsequent drawing step, the draw speed could be raised to only 1,000 m/min. The multifilaments thus produced were found to have a linear strength of only 3.5 g/d and an elongation of 150%.

The process of the present invention allows high-strength multifilaments to be produced by the direct spin and draw method without performing spinning and drawing in two separate steps.

What is claimed is:

1. A process for producing multifilaments having high fiber strength, comprising the steps of:

melt spinning a polyolefin at a first temperature into filaments;

cooling the spin filaments with a first chill means which is of a non-contact type and is held at a second temperature;

cooling the filaments at a third temperature with a second chill means which is of a contact type for forcibly conductively cooling the filaments; and drawing continuously the filaments at a high draw ratio in-line with heating rolls having a predetermined surface temperature so that the filaments cooled at said third temperature are directly and continuously treated by said heating rolls.

2. The process according to claim 1, wherein said first chill means comprises a cooling duct through which the filaments pass.

3. The process according to claim 1, wherein said second chill means comprises a chill roll.

4. The process according to claim 1, wherein said second chill means comprises a gathering agent supply roll for applying gathering agent to the filament.

5. The process according to claim 3, wherein said first temperature is in the range of 190° to 290° C.

6. The process according to claim 4, wherein said first temperature is in the range of 190° to 290° C.

7. The process according to claim 3, wherein said third temperature of said chill roll is in the range of 5° to 30° C.

8. The process according to claim 4, wherein said third temperature of said gathering agent supply roll is in the range of 5° to 30° C.

9. The process according to claim 1, wherein the predetermined surface temperature of said heating rolls is in the range of 80° to 150° C.

10. A process for producing multifilaments having high fiber strength, comprising the steps of:

melt spinning a polyolefin into filaments;

cooling the spun filaments with air by passage through a cooling duct;

cooling the filaments conductively with a chill roll having a surface temperature of 5°-30° C.; and then drawing continuously the filaments at high draw ratio in-line with a heating roll having a surface temperature of 80°-150° C.

11. A process for producing multifilaments, comprising the steps of:

melt spinning a polyolefin into filaments as it is melted in a die at a temperature of 190°-290° C.;

cooling the filaments by passage through a cooling duct;

quenching the filaments and supplying them with a gathering agent by means of a gathering agent supply roller cooled at 0°-10° C.;

continuously heating the filaments in-line with a heating roll having a surface temperature of 80°-150° C.; and drawing the filaments at high draw ratio.

12. The process according to claim 1, wherein said high draw ratio is in the range of 8-15.

13. The process according to claim 10, wherein said high draw ratio is in the range of 8-15.

14. The process according to claim 11, wherein said high draw ratio is in the range of 8-15.

* * * * *